United States Patent [19]

Zapara

[11] 4,106,248

[45] Aug. 15, 1978

[54] DEMOUNTABLE MODULAR DISPLAY SYSTEM FOR FURNITURE AND THE LIKE

[75] Inventor: Gerald A. Zapara, Santa Ana, Calif.

[73] Assignee: National Storage Systems, Inc., Newport Beach, Calif.

[21] Appl. No.: 766,428

[22] Filed: Feb. 7, 1977

[51] Int. Cl.[2] ..... E04H 3/04; A47F 10/00

[52] U.S. Cl. ..... 52/234; 312/108; 211/189; 52/79.12

[58] Field of Search ..... 211/189; 312/108, 111; 52/18, 73, 74, 234, 643, 79

[56] References Cited

U.S. PATENT DOCUMENTS

| | | | |
|---|---|---|---|
| 2,128,539 | 8/1938 | Roach | 52/73 |
| 2,580,334 | 12/1951 | Vanderveld | 211/189 |
| 2,971,805 | 2/1961 | Weiss | 312/108 |

FOREIGN PATENT DOCUMENTS

| | | | |
|---|---|---|---|
| 107,559 | 6/1939 | Australia | 52/74 |
| 562,399 | 6/1944 | United Kingdom | 52/18 |
| 680,720 | 10/1952 | United Kingdom | 52/73 |

*Primary Examiner*—James L. Ridgill, Jr.

*Attorney, Agent, or Firm*—Romney, Schaap, Golant, Scillieri, Disner & Ashen

[57] ABSTRACT

A demountable modular construction unit forming a walk-through display area. The wall and ceiling portions are connected by a cantilever member to eliminate vertical ceiling supports along the front and end peripheral boundaries. The modular units can be combined together in back-to-back or face-to-face or end-to-end relationships to form different combinations of display areas. The individual units are detachable into their component parts.

5 Claims, 13 Drawing Figures

DEMOUNTABLE MODULAR DISPLAY SYSTEM FOR FURNITURE AND THE LIKE

This invention relates generally to a demountable modular construction system, and specifically to wall and ceiling members attachable together through a truss suspension system to form a modular construction unit which defines a walk-through display area having no upstanding supports along its three front boundaries. It also relates the use of various combinations of a plurality of such modular units In the past, it has been desirable to provide furniture stores and the like with permanently installed laterally spaced stud background walls forming two elongated display areas with an aisle therebetween. This enabled customers to walk down the aisle and view different furniture displays against coordinated floor coverings and background coverings. However, such permanent construction requires extensive long term lease arrangements and excessive construction expenses, provides little or no flexibility in altering the basic display combinations, and provides no opportunity for short-term test marketing at a new store location.

It is therefore an object of the present invention to provide a modular construction system which can be installed in various space lay-outs, and which has interchangeable components.

Another object is to make each unit demountable so that they can be transported as separate component parts before installation or after dismantling.

More specifically, it is an object of the present invention to provide a truss suspension system attachable to the top of vertical posts to support a ceiling overhanging the display area.

Another specific object is to provide a demountable modular construction system having interchangeable posts and wall panels forming a vertical wall portion, and also having interchangeable truss suspension members and lateral panels forming a ceiling portion. A related object is to provide different combinations of modular construction components, such as a single ceiling portion attached to the top end of a wall portion forming an inverted L-shaped member in a first exemplary combination; two ceiling portions oppositely attached to the top end of a wall portion forming a T-shaped member in a second exemplary combination; and two wall portions connected through their ceiling portions forming an inverted U-shaped member in a third exemplary combination.

Another object is to provide various combinations of modular construction units in face-to-face, end-to-end, and back-to-back combinations in order to make different arrangements of adjoining display areas connected by longitudinal and transverse aisles.

Another object of the invention is to provide an improved cantilever member formed by a truss having simple structural elements which can be easily assembled but which nevertheless provides rigid and secure stability for suspending the ceiling and the various elements attached thereto over the display area without underlying vertical supports.

Additional objects and purposes and advantages of the invention will be apparent to those skilled in the art in view of the following description of a preferred embodiments of the invention.

In the drawings

Figure 3:
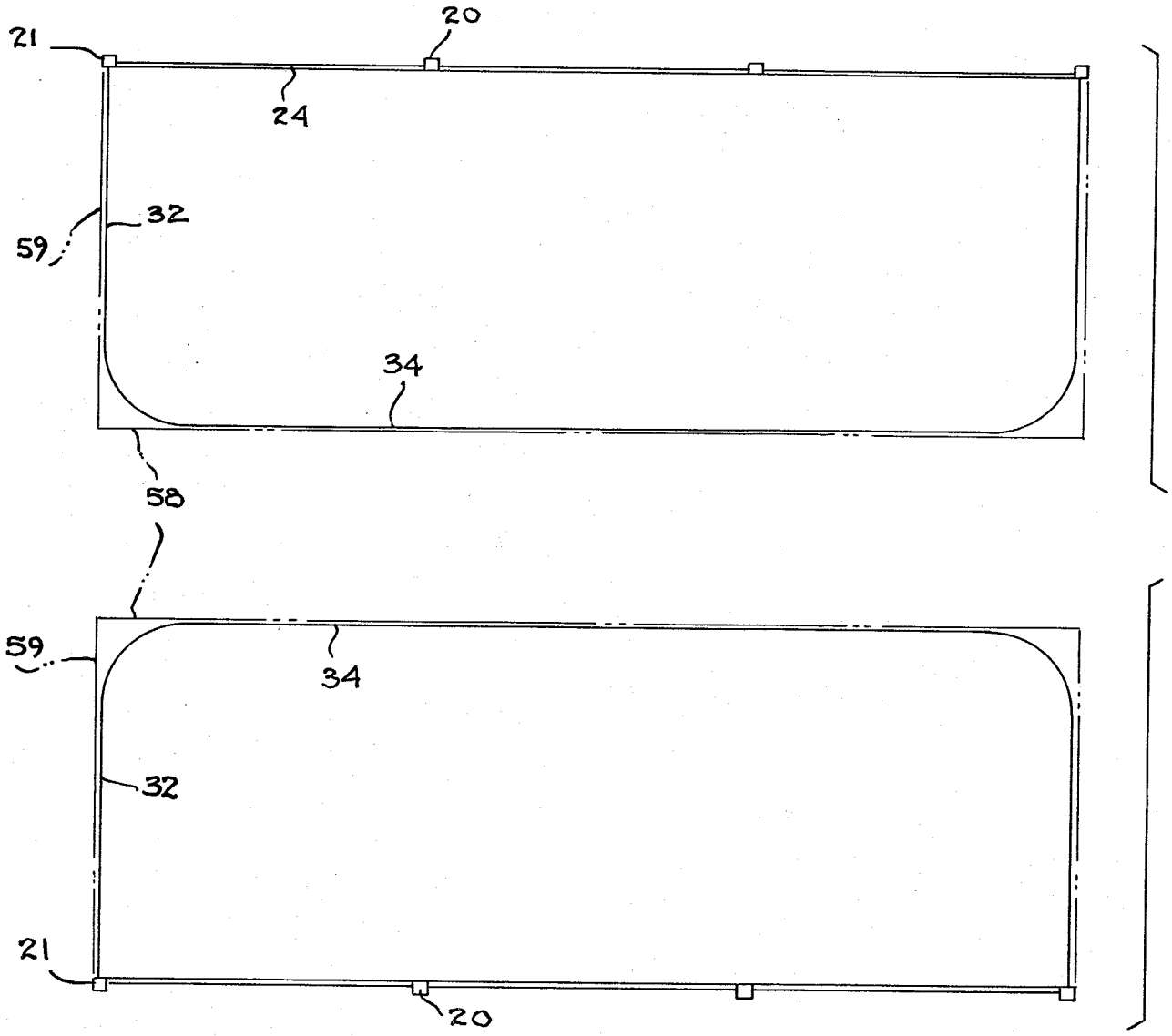
FIG. 3 is a top schematic view of FIG. 1 showing the outline of a ceiling panel and the peripheral boundaries of an underlying display area.
Figure 4:
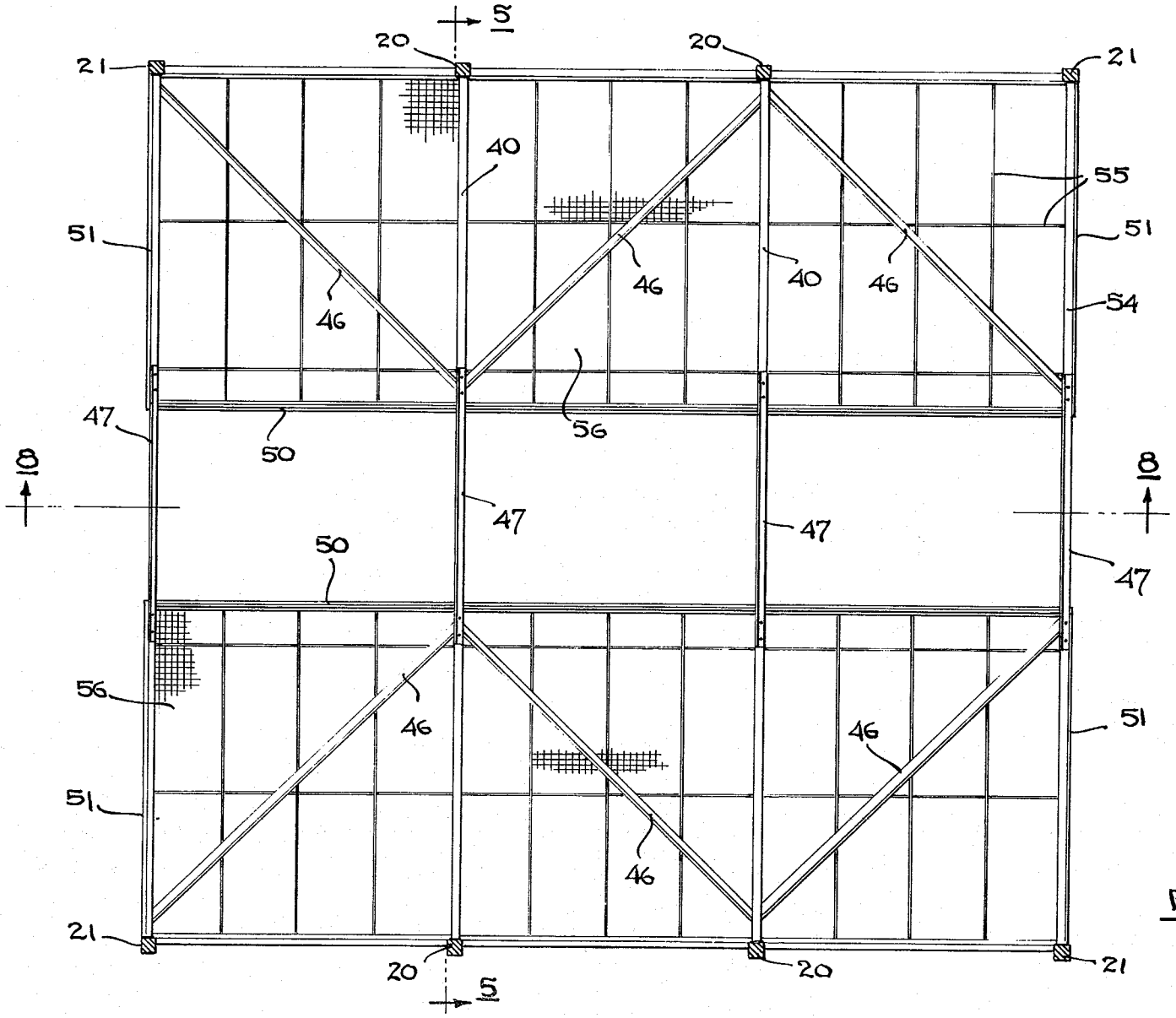
FIG. 4 is a top plan view of the embodiment of FIG. 1 showing the demountable cantilever members and the underlying demountable ceiling panel.

Generally speaking, the invention has two interrelated aspects, as shown in the drawings. From a general point of view, the invention relates to the use of individual modular construction units which form a three-dimensional display area having a predetermined bottom floor boundary. By combining such modular units together in different permutations and combinations, various composites of aisles and display areas can be developed to fit variously shaped and sized floor areas without actually construction permanent wall studs and ceiling joist therein. In this regard, a pair of modular units may be combined in face-to-face relationship with a continuous ceiling connecting the two walls. This enables a customer to walk along a central aisle and view furniture or other items displayed on both sides of the aisle. In addition, the customer can walk into the display area or from one display area to another without any visual or physical obstructions. As shown in FIG. 3, in the preferable construction, the peripheral boundaries of the ceiling portions substantially coincide with the peripheral boundaries of the display.

Figure 11:
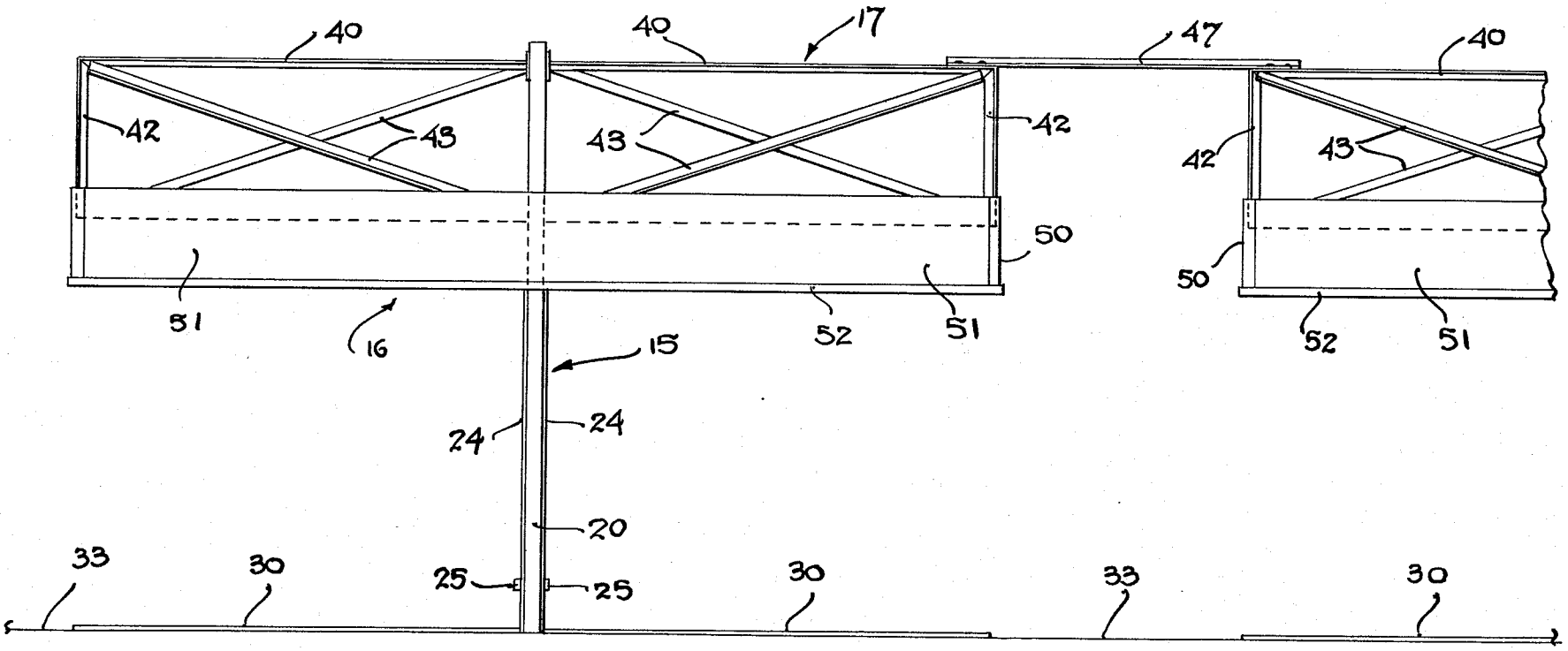
FIG. 11 is an end view showing an exemplary composite of two back-to-back modular units combined with another unit in face-to-face relationship.
Figure 12:
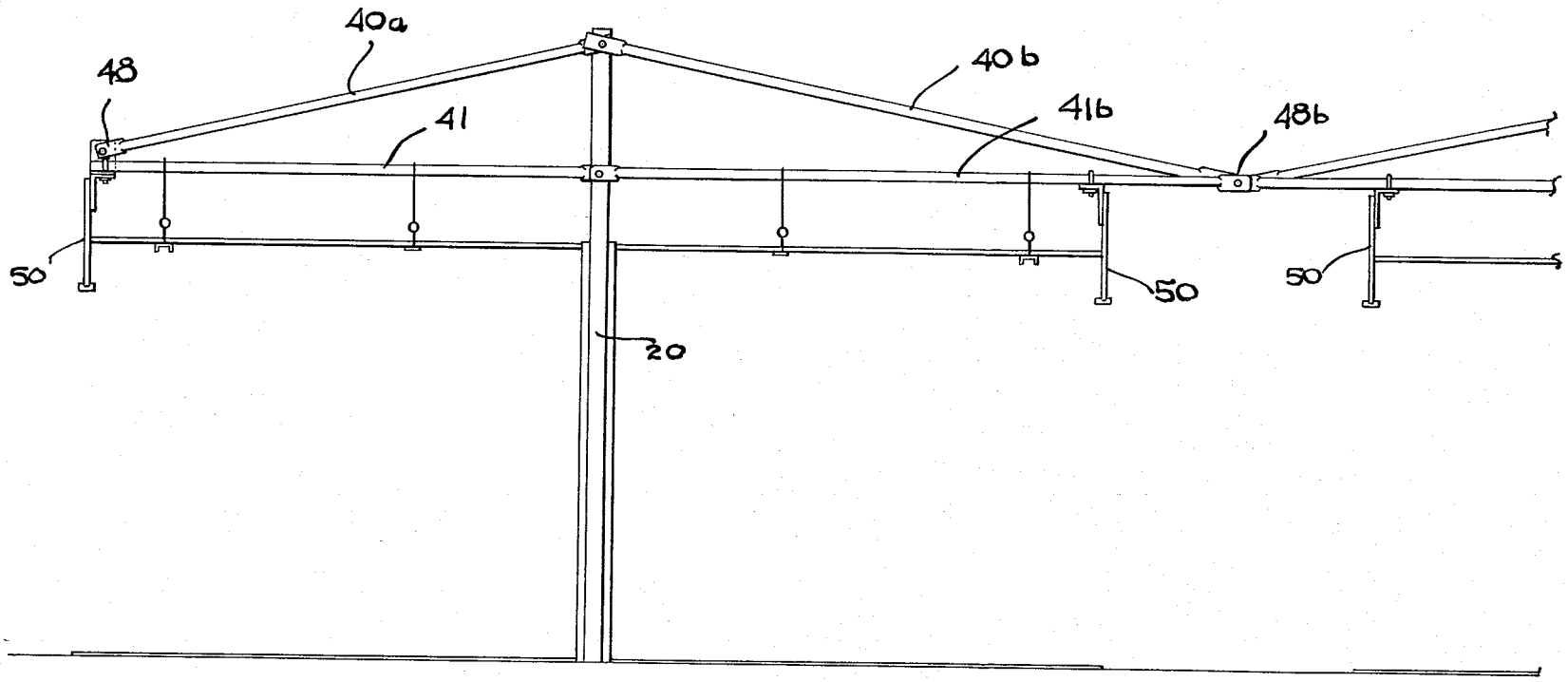
FIG. 12 is an end view showing two modular units with a modified form of cantilever member.

Other exemplary subcombinations which form composite elements are illustrated in FIG. 11 which shows on the left a typical pair of modular units in back-to-back relationship having a common wall separating two adjacent display areas. On the right portion of the drawing of FIG. 11 are shown a pair of modular units in face-to-face relationship. When viewed from a cross section, the ceiling and wall portions in the illustrated embodiment take on an inverted L-shape configuration, or an inverted U-shape configuration, or a T-shape configuration or combinations thereof. The combination of modular units shown in FIG. 12 shows a U-shape configuration incorporating a modified pair of truss suspension members.

Figure 1:
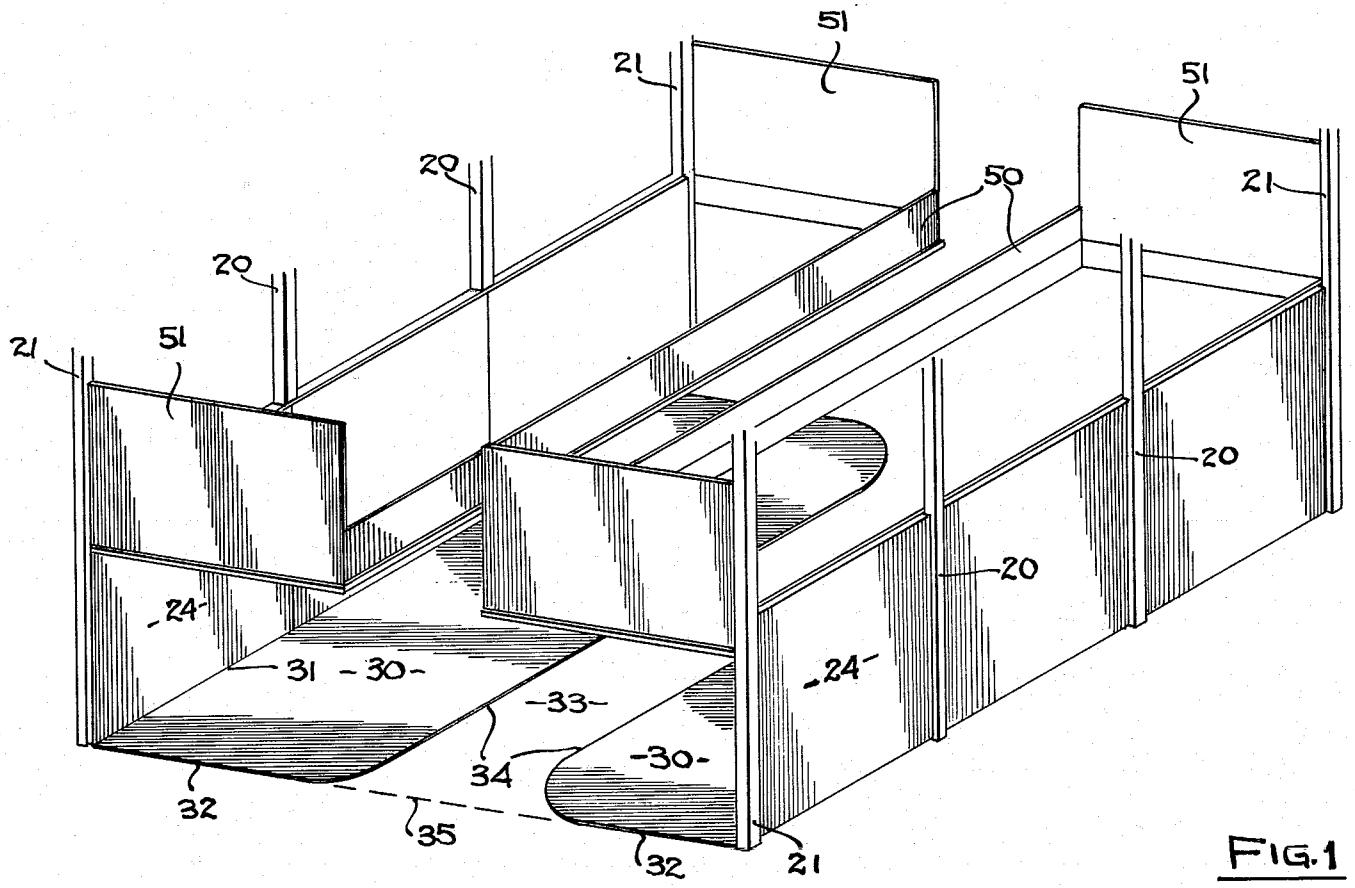
FIG. 1 is a perspective view showing a presently preferred embodiment of the invention with two modular units in face-to-face relationship.
Figure 2:
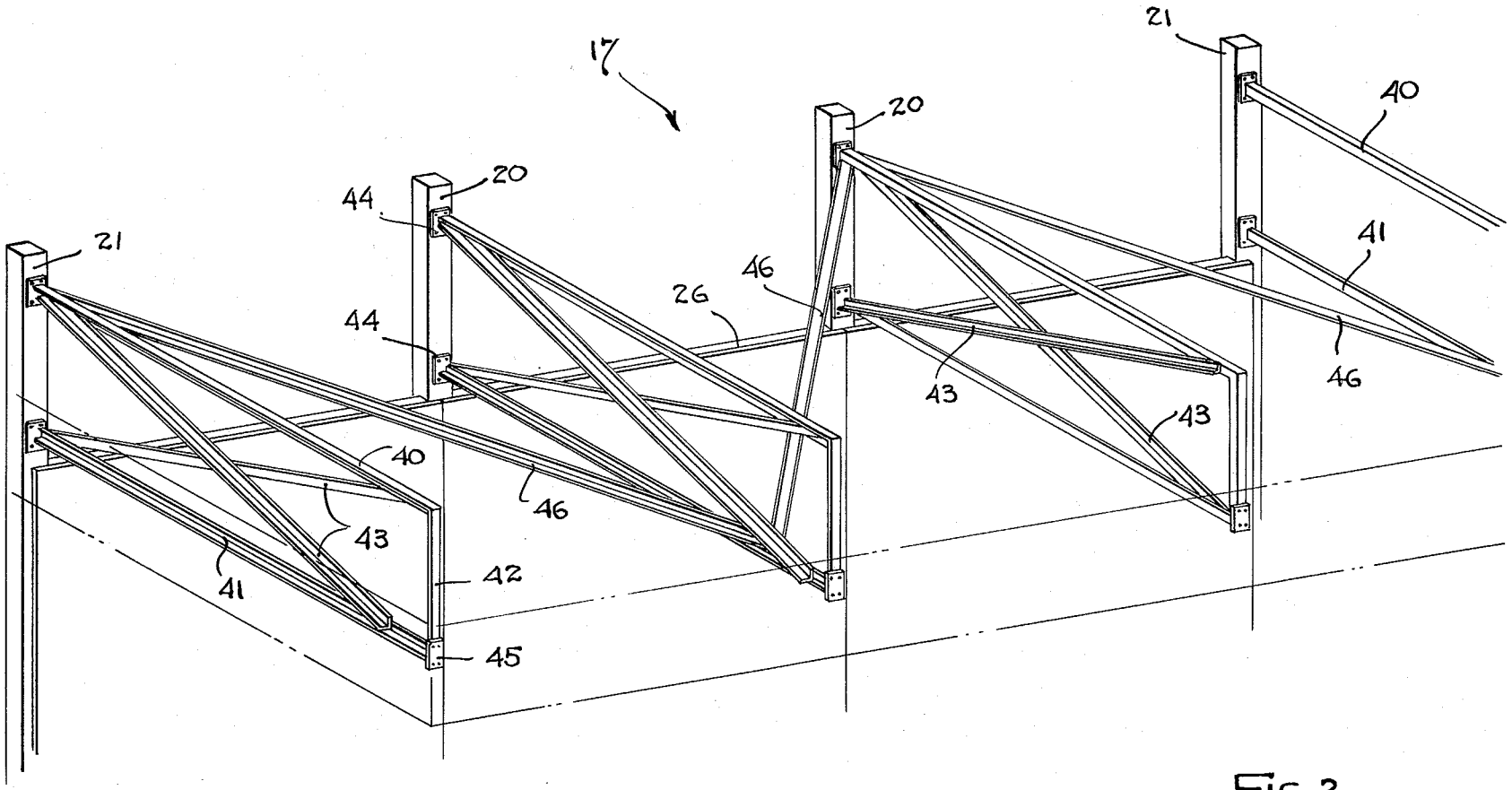
FIG. 2 is a perspective view of a presently preferred embodiment of the demountable cantilever members.
Figure 5:
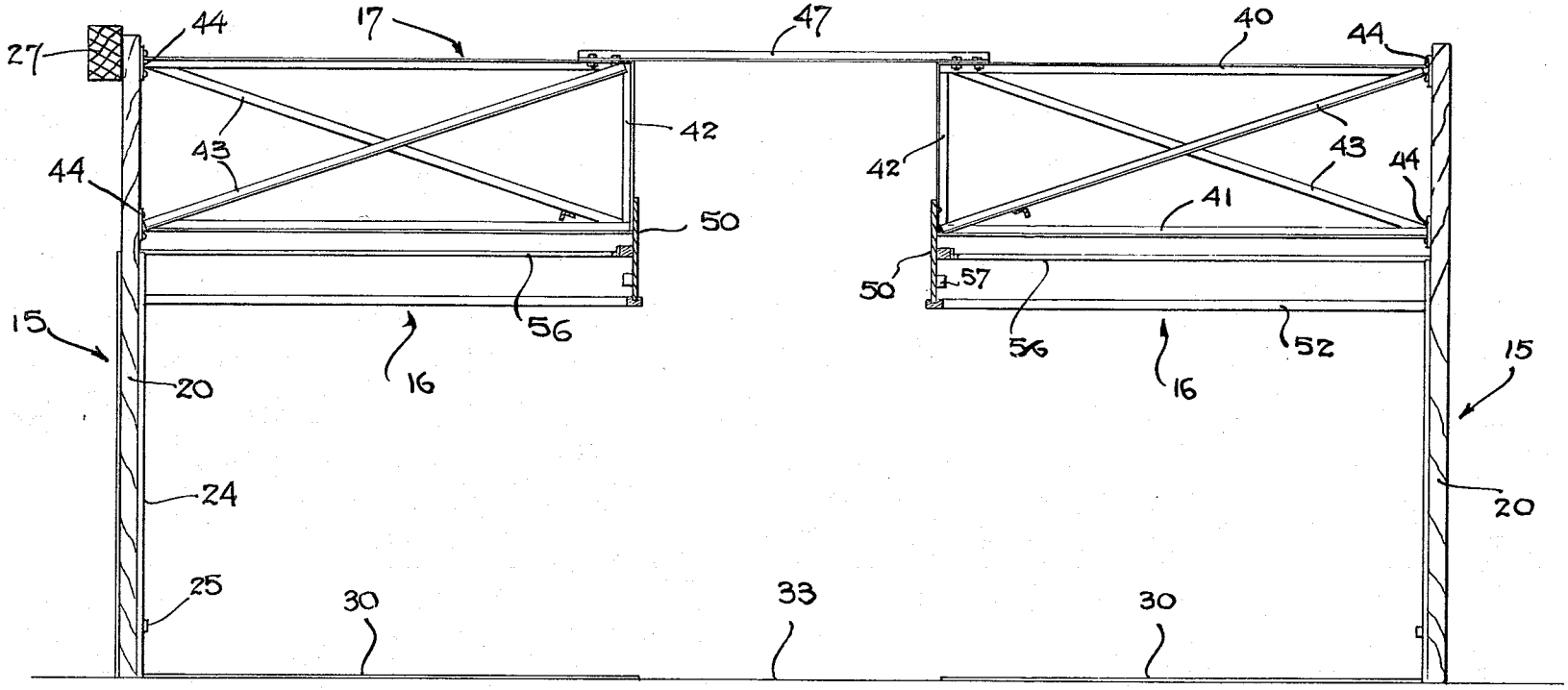
FIG. 5 is an enlarged cross-section of FIG. 4 taken along line 5—5.
Figure 7:
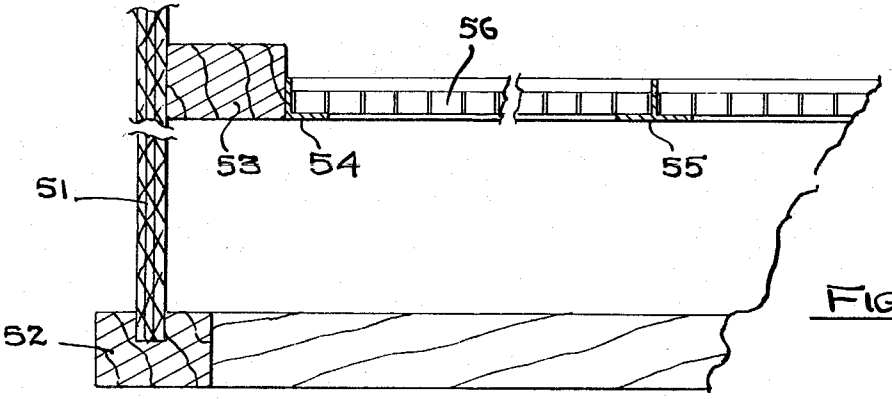
FIG. 7 is an enlarged fragmentary sectional view showing the structural details of the ceiling panel.
Figure 6:
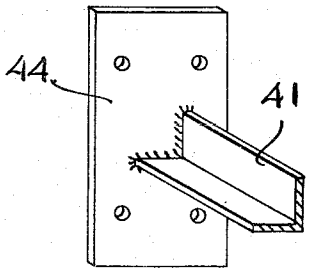
FIG. 6 is an enlarged close-up view showing an exemplary cantilever mounting bracket.
Figure 8:
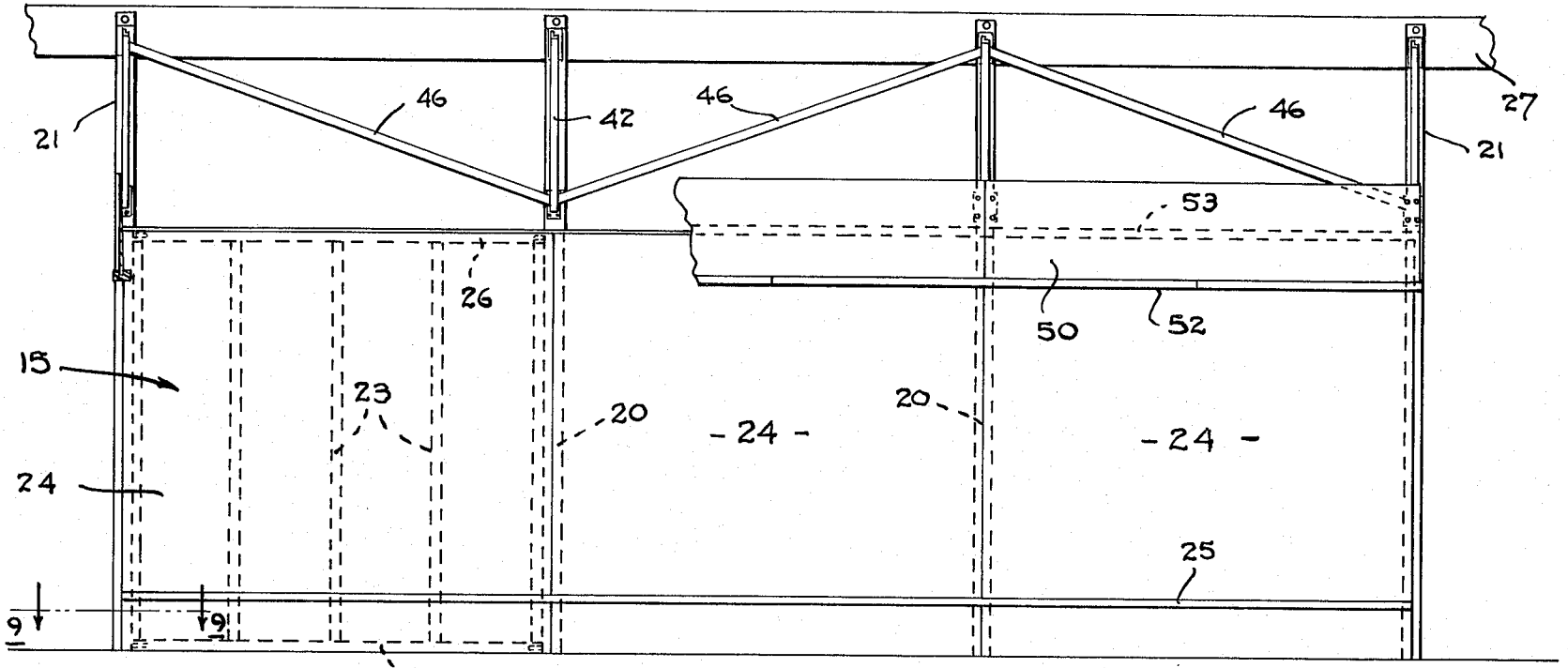
FIG. 8 is a front elevational view, partly in section, taken along the line 8—8 in FIG. 4.
Figure 10:
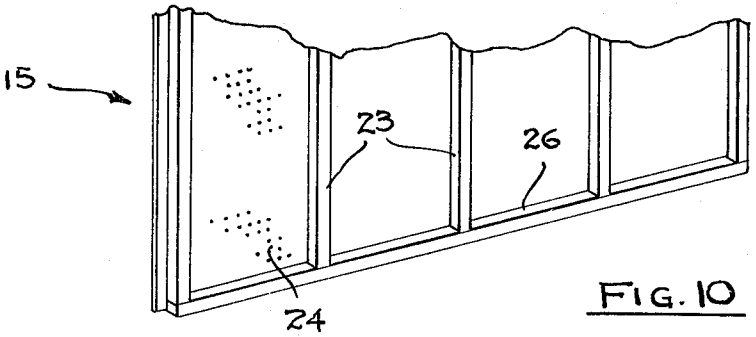
FIG. 10 is an enlarged fragmentary perspective view showing the wall panel construction details.
Figure 9:
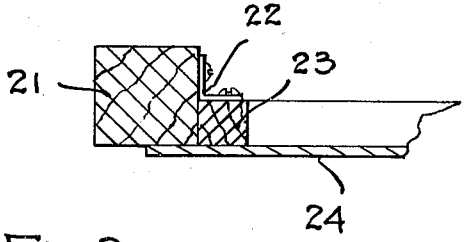
FIG. 9 is a fragmentary enlarged sectional view taken along the line 9—9 in FIG. 8 showing an exemplary connection between a post and a wall member.

The specific aspect of the invention relates to the demountable construction features of each individual modular unit. In this regard, the demountable feature of the cantilever member is shown in FIG. 2 as well as its detachable connections to the ceiling and wall portions. The demountable construction features of the ceiling and its removable panels are best shown in FIGS. 5 and 7. This provides a further advantage of enabling the lessee of a building to utilize the existing overhead fire sprinkler devices, heating and ventilation equipment, and the like, without separate construction thereof. The demountable construction details of the wall portion and its detachable panels are best shown in FIGS. 8, 9 and 10, as well as the modified construction form shown in FIG. 13.

It is the unique cantilever construction of each individual modular unit which facilitates the unique method of combining a plurality of modular units into a composite display system, as discussed in more detail below.

Referring more specifically to the drawings, the modular units of the exemplary embodiment include a wall portion 15, a ceiling portion 16 and a cantilever member 17 connected between the intersecting wall and ceiling portion thereby suspending the ceiling above the floor without additional vertical supports. More specifically, the wall portion includes interior posts 20 which are preferably interchangable with corner posts 21, both of which are attachable on their lower ends to a floor. The wall paneling is preferably provided between the posts to provide a suitable background for the items on display. In order to make the wall paneling detachable from the posts the illustrated structure includes angle brackets 22, vertical studs 23, composition board 24, and lateral studs 26, all of which are interconnected between the posts to structurally and aesthetically integrate the wall unit. In a typical configuration, the composition board is affixed to the vertical and lateral studs which are connected through the angle brackets to the posts. A plug mold 25 extends all along the wall to provide maximum space flexibility in displaying lamps, radios, television and other electrical items. Where possible, building beams 27 can be used to stabilize the top of the posts.

The modular units can be sized to fit any predetermined floor display area such as an exemplary carpeted display area 30 defined by a back boundary 31 and end boundaries 32. The display area preferably fronts on a longitudinal aisle 33 formed by junction 34 and imaginary end boundaries 35. By combining modular units in discontinuous end-to-end relationship a cross aisle 36 can be employed to facilitate movement laterally between separated display areas.

In the preferred embodiment, each of a plurality of cantilever members 17 include a truss having upper and lower horizontal arms 40, 41, connected at their forward ends by a leg 42, with a central X-brace 43 connected between the ends of the arms and legs. To facilitate demountable attachment of the truss to the wall and ceiling portions, rear and forward brackets 44, 45 are provided. Additional truss stability is provided by a diagonal brace 46 and an aisle tie 47. Symmetrical holes are preferably provided in the truss to enable the diagonal brace to be affixed from the high portion of one truss to a low portion of an adjacent truss. As best shown in FIG. 2, optimum stability and strength is believed to be obtained by having the rear attachment high and the forward attachment low. The aisle tie may be used to provide integral stability between adjacent modular units by laterally connecting face-to-face units (See FIG. 5) or by longitudinally connecting end-to-end units (not shown).

Referring now to the ceiling portion 16 in the illustrated form, it includes front and end facia 50, 51 directly attached to the trusses and forming with a notched soffit 52 a continuous facade around the lower portion of the cantilever. The facia members carry a support bar 53 on the interior side for engaging a plurality of angle irons 54 and double angle irons 55. In the preferred embodiment, removable ceiling tiles 56 are placed on top of the angle irons. An electric line 57 extends all along the inside portion of the overhanging facade to provide the necessary lighting for the items on display.

Figure 13:
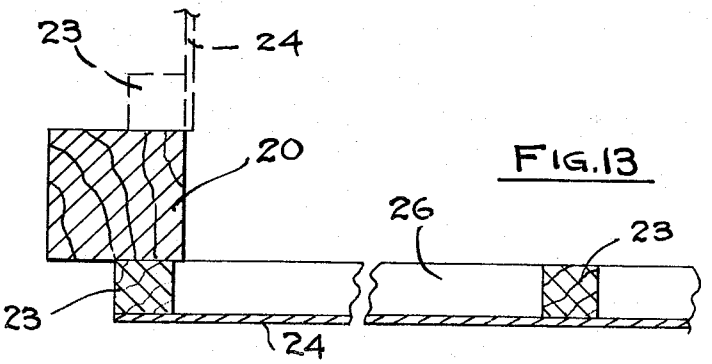
FIG. 13 is an enlarged fragmentary sectional view showing a modified connection between a post and a wall member.

Referring to FIG. 13 a modified connection is shown between the vertical stud 23 of the wall panel and the interior post 20, eliminating the need for any composition board edge portion overlapping the post, as previously shown in FIG. 9. This makes it possible, where desirable, to butt the end of the wall panel directly into the post, as shown by the dotted lines.

Although it is not necessary, the preferred embodiment is constructed so that the front and end boundaries 58, 59 of the ceiling substantially overlie and coincide with the aisle display junction 34 and the end boundaries 32 of the display area, with an intersection line 60 between the wall and ceiling members substantially overlying and coinciding with the back boundary 31 of the display area.

With respect to FIG. 12, a modified cantilever construction includes an oblique upper arm **40*a* which extends downwardly to meet the lower horizontal arm 41 at a junction 48. Where the unit is placed in face-to-face combination with another unit, both arms 40*b*, 41*b* are elongated to position a new junction 48*b* in the middle of an aisle in front of the ceiling members, thus eliminating the need for an aisle tie 47**. This modified form of construction also appears to provide good stability for both T-shape and inverted U-shape composites. In prototype installations, a two-inch diameter steel tube has been successfully used for the arms of the truss described above.

It will thus be understood from the foregoing description, with reference to the appropriate drawings, that each modular display unit of the present invention is formed by a few simple component parts which can be efficiently assembled or dismantled. Moreover, a plurality of modular units can be joined to form numerous combinations of display and aisle areas without the need for utilizing conventional permanent wall and ceiling construction.

Although an exemplary embodiment of the invention has been disclosed for illustrative purposes, it will be understood that various changes, modifications and substitutions may be incorporated in such embodiment without departing from the invention as defined by the claims hereinafter.

I claim:

1. In a walk-through display area incorporating an existing floor and a pre-determined area for viewing merchandise under a ceiling and in front of an upright background panel without any structural obstacles along the front and side boundaries of the walk-through display area, a modular construction system for carrying the background panels and the ceiling comprising:

a plurality of vertical posts mountable on the floor and each having a lower portion below a ceiling reference point for carrying the background panels and an upper portion above the ceiling reference point;

a separate truss member attachable to and cantilevered from the upper portion of each post over the walk-through display area and including a plurality of coplanar support beams extending forwardly to carry the ceiling under the truss member and overlying the walk-through display area; and single brace means connectable between adjacent truss members from the rear of one truss member to the front of another truss member to cover an enlarged display area by positioning the vertical posts and their corresponding truss members in side-by-side relationship.

2. The modular structure of claim 1 wherein said vertical posts include a second truss member extending oppositely from said first recited truss member to cover an enlarged and separated display areas on both sides of the background panels.

3. The modular structure of claim 1 wherein said truss members each include top and bottom beams, and wherein said single brace means comprises a cross-beam connectable between the rearward end of one of said top and bottom beams to the forward end of the other of said top and bottom beams.

4. The modular structure of claim 3 wherein said truss members include means for connecting the forward end of one truss member to the forward end of an oppositely positioned truss member to cover and enlarged display area by positioning certain of the vertical posts and their corresponding truss members in face-to-face relationship.

5. The modular structure of claim 3 wherein said truss member includes X-shaped diagonal brace means extending between its top and bottom beams, and wherein said single brace means extends from the rearward end of said top beam of one truss member to the forward end of said bottom beam of a laterally adjacent truss member.

* * * * *